US006407339B1

(12) United States Patent
Rice et al.

(10) Patent No.: US 6,407,339 B1
(45) Date of Patent: Jun. 18, 2002

(54) CERAMIC ELECTRICAL INSULATION FOR ELECTRICAL COILS, TRANSFORMERS, AND MAGNETS

(75) Inventors: John A. Rice, Longmont; Craig S. Hazelton, Lafayette; Paul E. Fabian, Broomfield, all of CO (US)

(73) Assignee: Composite Technology Development, Inc., Lafayette, CO (US)

( * ) Notice: Subject to any disclaimer, the term of this patent is extended or adjusted under 35 U.S.C. 154(b) by 0 days.

(21) Appl. No.: 09/390,379

(22) Filed: Sep. 3, 1999

Related U.S. Application Data

(60) Provisional application No. 60/099,130, filed on Sep. 4, 1998.

(51) Int. Cl.[7] ..... H01B 7/00
(52) U.S. Cl. ..... 174/110 SR; 174/137 B
(58) Field of Search ..... 174/110 R, 110 SR, 174/137 B, 138 C

(56) References Cited

U.S. PATENT DOCUMENTS

| | | | | |
|---|---|---|---|---|
| 4,189,392 A | * | 2/1980 | Penneck et al. | 174/137 B |
| 4,219,607 A | * | 8/1980 | Cammack et al. | 174/110 SR |
| 4,342,814 A | | 8/1982 | Usuki et al. | 428/383 |
| 4,429,007 A | * | 1/1984 | Bich et al. | 174/110 R |
| 4,506,109 A | | 3/1985 | Onishi et al. | 174/128 S |
| 4,562,164 A | * | 12/1985 | Miyazaki et al. | 174/110 R |
| 4,647,888 A | | 3/1987 | Woolf et al. | 335/216 |
| 4,652,218 A | | 3/1987 | Tsutsui et al. | 417/368 |
| 4,679,020 A | | 7/1987 | Kawamura et al. | 335/216 |
| 4,694,268 A | | 9/1987 | Kawamura et al. | 335/216 |
| 4,694,269 A | | 9/1987 | Burnett et al. | 335/216 |
| 4,808,653 A | * | 2/1989 | Haluska et al. | 524/398 |
| 4,954,481 A | | 9/1990 | DeReggi et al. | 505/1 |
| 4,977,039 A | | 12/1990 | Onishi et al. | 428/623 |
| 4,990,491 A | | 2/1991 | Wagner et al. | 505/1 |
| 5,021,401 A | | 6/1991 | Snyder et al. | 505/1 |
| 5,045,526 A | | 9/1991 | Nagesh et al. | 505/1 |
| 5,105,531 A | | 4/1992 | Sawada et al. | 29/605 |
| 5,139,820 A | * | 8/1992 | Sawada et al. | 174/110 A |
| 5,140,292 A | | 8/1992 | Aronow | 336/205 |

(List continued on next page.)

OTHER PUBLICATIONS

Schutz et al., "Inorganic and hybrid insulation materials for ITER", *Advances in Cryogenic Engineering,* 40:985–991, (Dec., 1994).

Lawless WN, "Dielectric insulations incorporating thermal stabilization for A15 and ceramic superconductors", IECEC–98–039, (Aug., 1998).

*Primary Examiner*—Jeffrey Sterrett
(74) *Attorney, Agent, or Firm*—Stout, Uxa, Buyan & Mullins, LLP; Donald E. Stout; Greg S. Hollrigel

(57) ABSTRACT

A high temperature electrical insulation is described, which is suitable for electrical windings for any number of applications. The inventive insulation comprises a cured preceramic polymer resin, which is preferably a polysiloxane resin. A method for insulating electrical windings, which are intended for use in high temperature environments, such as superconductors and the like, advantageously comprises the steps of, first, applying a preceramic polymer layer to a conductor core, to function as an insulation layer, and second, curing the preceramic polymer layer. The conductor core preferably comprises a metallic wire, which may be wound into a coil. In the preferred method, the applying step comprises a step of wrapping the conductor core with a sleeve or tape of glass or ceramic fabric which has been impregnated by a preceramic polymer resin. The inventive insulation system allows conducting coils and magnets to be fabricated using existing processing equipment, and maximizes the mechanical and thermal performance at both elevated and cryogenic temperatures. It also permits co-processing of the wire and the insulation to increase production efficiencies and reduce overall costs, while still remarkably enhancing performance.

14 Claims, 1 Drawing Sheet

U.S. PATENT DOCUMENTS 5,212,013 A * 5/1993 Gupta et al. ..... 174/110
5,231,366 A 7/1993 Haramaki et al. ..... 335/216
5,246,729 A 9/1993 Gupta et al. ..... 427/62
5,296,260 A 3/1994 Sawada et al. ..... 427/118
5,336,851 A * 8/1994 Sawada et al. ..... 174/110 A
5,364,709 A 11/1994 Yu ..... 428/662
5,519,172 A * 5/1996 Spencer et al. ..... 174/110 R
5,531,015 A 7/1996 Manlief et al. ..... 29/599
5,635,250 A * 6/1997 Blum et al. ..... 427/387
5,636,434 A 6/1997 Okey et al. ..... 29/605
5,750,643 A * 5/1998 Blum et al. ..... 528/481
5,798,678 A 8/1998 Manlief et al. ..... 335/216
6,030,255 A * 2/2000 Konishi et al. ..... 174/138 B
6,106,954 A * 8/2000 Meguriya et al. ..... 174/137 B

* cited by examiner

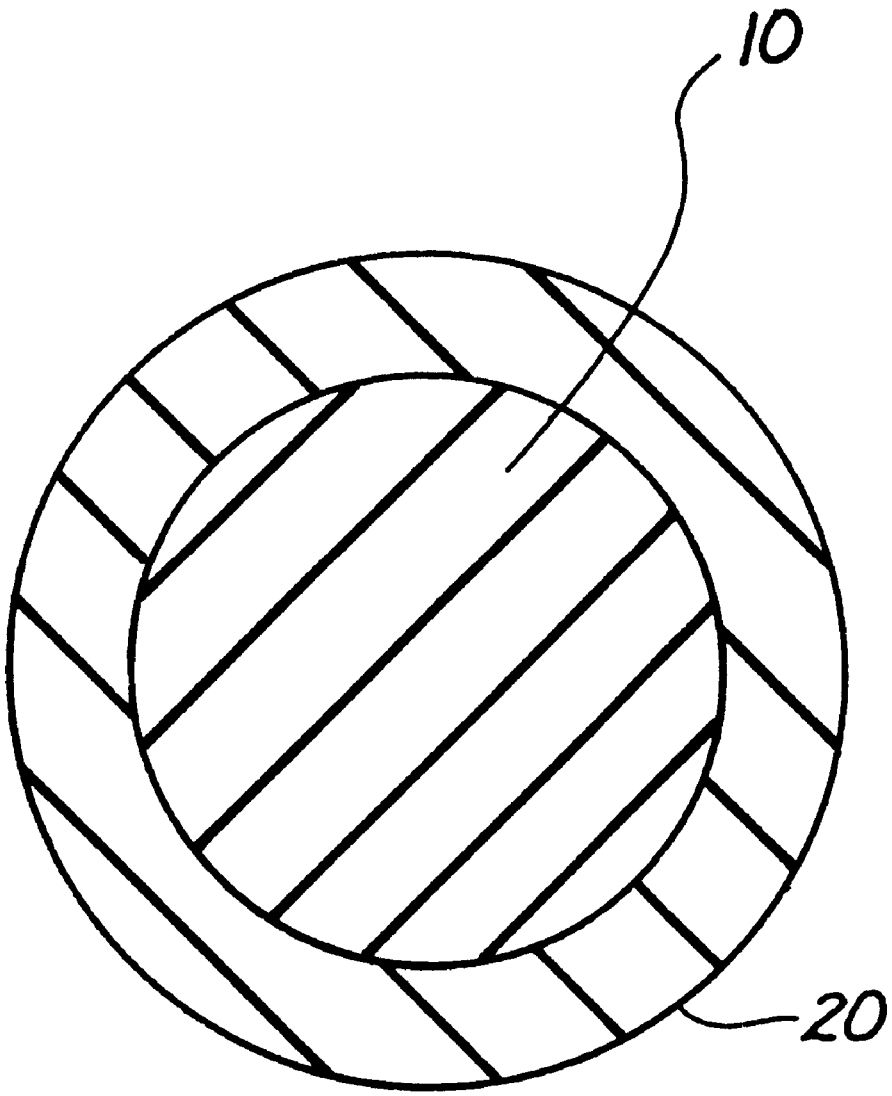
10
20

CERAMIC ELECTRICAL INSULATION FOR ELECTRICAL COILS, TRANSFORMERS, AND MAGNETS

This application claims the benefit of U.S. Provisional Application Serial No. 60/099,130, filed Sep. 4, 1998, which is commonly owned, and the contents of which are expressly incorporated herein by reference.

This invention was made with Government support under Grant DE-FG03-96ER82147 awarded by the Department of Energy. The Government has certain rights in this invention

BACKGROUND OF THE INVENTION

This invention relates to electrical insulation for devices having electrical windings, and more particularly to electrical insulation which has specifically improved temperature stability and performance characteristics.

Electrical coils, transformers, and magnet devices used at or near room temperature are typically insulated using varnish insulation or other easy to apply polymer coatings. Higher temperature devices use stronger and more stable plastics in order to accommodate an upper limit operating temperature of approximately 200° C. (390° F.). Superconducting coils and magnets must withstand temperature fluctuations from above room temperature down to almost −270° C. (−454° F.) and therefore typically use advanced glass fiber reinforced epoxy resins. However, none of these insulation systems is capable of surviving manufacturing or use temperatures above approximately 250° C. (480° F.).

Improved energy efficiency can often be obtained by raising the operating temperature of electrical coils and transformers. Production and operating costs can also be lowered with the elimination of cooling systems. The possible applications for these devices could be greatly multiplied if the need for protective coverings and thermal shielding from the hot sun or other heat producing machines could be eliminated.

In many instances, the unavailability of a suitable high temperature insulation material creates high production costs and inefficiencies. For example, some niobium tin superconducting magnets are wound and then heat treated at approximately 600 to 800° C. In the state of the art production processes, the coil then must be carefully unwound slightly to allow for the wrapping of glass reinforced epoxy insulation. Finally, the coil is rewound into the final shape. Clearly, this complicated process greatly increases the final costs of the product. A high temperature wrappable insulation, which could be applied before the niobium tin superconducting magnets were wound and heat treated, would save tremendous amounts of labor and time, increasing productivity, reducing loss, and resulting in greatly decreased final product costs.

Some prior art approaches involve using alternative insulation materials to increase the temperature limits of electrical coils, transformers and magnets. For example, ceramic coatings and layers have been applied in specialty applications to raise the maximum temperature limits to very high levels. Most of the examples of prior art discussed below involve the special case of superconducting coils and magnets. However, the principles and disadvantages described are equally applicable to normal metal wire coils, transformers and magnets.

U.S. Pat. No. 5,336,851 to Sawada et al. discloses methods for insulating an electrical conductor wire having a high operating temperature by placing up to three layers of ceramic particles around the conductor. Applying multiple ceramic layers can be complicated and add cost to the conductor. Also, the particles produced are very weakly bonded together because the processing temperature cannot be raised high enough to fuse them without melting the electrical conductor.

U.S. Pat. No. 5,139,820 to Sawada et al. describes a method of manufacturing ceramic insulated wire by extruding an inorganic gel around the conductor. However, gels typically shrink significantly upon densification (20 to 50 volume percent or more) to their final state. This shrinkage can cause cracks in the insulation or change the desired dimensions of the coil.

U.S. Pat. No. 5,212,013 to Gupta et al. discloses methods for insulating superconducting wire with an inorganic glass ceramic composite system wire insulation. The problem with this approach is that the composition of this system would need to be modified for each heat treatment temperature desired for the superconductor. The glasses melt in a narrow temperature range and would only have the desired viscosity in that same narrow range. Too high a viscosity and the insulation would not fuse into a continuous layer, ruining the electrical insulation properties. Too low a viscosity and the composite would flow, allowing the conductors to move and possibly touch, again ruining the electrical insulation properties. This system would be complicated to apply in a manufacturing environment, to the point of impracticality.

William N. Lawless, a co-inventor of U.S. Pat. No. 5,212,013, states in his paper Dielectric Insulations Incorporating Thermal Stabilization for A-15 and Ceramic Superconductors, presented at IECEC-98-039 in Aug. 1998 that glass is the only other viable co-firable material for insulating superconductors.

U.S. Pat. No. 4,429,007 to Bich et al. discloses electrical wire insulation for an electromagnetic coil, wherein the wire is coated with a ceramic powdered slurry. This method has the same narrow temperature range as described in U.S. Pat. No. 5,212,013, and the composition must also be changed if the heat treatment of the superconductor is at a temperature other than 750° to 790° C. In addition, the 14-step heating process as outlined is long and involved, adding unnecessary expense to the final product.

Enhanced electrical insulation is needed to take advantage of many new developments in the field of superconducting magnets. The higher temperature processing required for "A-15" compounds (e.g. niobium-tin and niobium-aluminum) and oxide (high temperature) superconductors makes compatibility with the insulation even more difficult. New insulation demonstrating increased strength and modulus would substantially improve magnet performance. In addition, insulation capable of surviving wind and react processing would significantly lower cost.

Many magnet designs require an insulate-before-winding approach in order to achieve top performance. Due to bend strain limitations of A-15 and HTS conductors, a wind-before-react technique is required for complex shapes with tight bends (saddle coils or dipoles for MHD, motors, and generators). Niobium tin and oxide superconductors are inherently brittle after heat treatment. All handling performed in this brittle state must limit the strain applied to a fraction of one percent. For example, the current value being used in industry for ITER (International Thermonuclear Experimental Reactor) type magnets is 0.1% strain. In order to obtain the desired conductor placement and turning radii, the conductor must be shaped and wound into the coil prior to heat treatment. However, current high performance organic insulation cannot survive these conditions. Therefore, magnet manufacturers have had to very carefully "unwrap" the magnet after heat treating in order to insulate it. As described supra, this step adds extra cost as well as limits the ultimate design.

To summarize the current state of the art, as described above, we have provided a listing of the problems presently encountered with current organic and inorganic insulation approaches:

Problems with current organic insulation (a) Coils manufactured with organic insulation systems must have all the high temperature processing completed before the insulation can be applied. This limits the fabrication of some devices and increases the cost of others.

(b) The maximum temperature during operation is limited by the temperature stability of the organic insulation. Design changes or additional costs associated with cooling or thermal barriers are (b) The maximum temperature during operation is limited by the temperature stability of the organic insulation. Design changes or additional costs associated with cooling or thermal barriers are required to operate above these limits, which are quite low, typically no more than about 200° C.

(c) Devices made with organic insulation are more susceptible to damage from ionizing and non-ionizing radiation. Useful lifetimes are diminished if additional radiation shielding is not used.

Problems with current inorganic insulation (a) Prior art inorganic insulation systems suffer from complex processing methods, such as plasma spraying, that make them difficult to apply to thin wires or conduits. Applying multiple layers on a wire are more expensive than single layers.

(b) Some ceramic insulation systems use particulate ceramic powders. However, in order to achieve high strength and electrical isolation, very high temperatures are required during processing that will melt the metal in the conductor. Superconductor materials are heat treated at too low of a temperature (600° C. to 1000° C.) to allow these powders to sinter together and achieve the desired properties.

(c) Some glass insulation systems use particulate glass powders. These often have a very limited processing temperature range where the insulation is fluid enough to fuse together but not too fluid to flow out from between the wires. Both too little and too much flow will lower the performance of the device.

(d) Glass insulation systems also have a narrow range of (e) The narrow range of composition mentioned above limits the addition of thermal control additives to improve properties such as thermal conductivity or specific heat. Several ceramic powders have been identified that possess enhanced thermal performance at specific temperatures (such as 4 K to 8 K) for superconducting magnets (see, for example, U.S. Pat. No. 5,212,013 to Gupta). The use of any of these components would upset the processing temperature range of glass insulation and require reformulation.

(f) Ceramic insulation systems that extrude a gel or mixture of powders are hard to reinforce with continuous fibers. The mechanical strength of the coil or magnet is lower than if a fabric could be used. The shrinkage associated with the densification of sol-gel insulation systems will generate cracks around the metal wire and any fiber reinforcement. Cracks will lower the electrical and mechanical strength of this type of insulation.; and (g) Solid ceramic insulation is brittle after application on the wire or conductor. Applying the insulation in its final form prior to winding the coil will limit the radius of curvature that can be achieved without cracking the insulation. Tight, small coils cannot be made with pre-applied, dense ceramic insulation.

SUMMARY OF THE INVENTION

The preceramic polymer insulation invention described herein allows conducting coils and magnets to be fabricated using existing processing equipment, and maximizes the mechanical and thermal performance at both elevated and cryogenic temperatures. It also permits co-processing of the wire and the insulation to increase production efficiencies and reduce overall costs, while still remarkably enhancing performance.

More particularly, there is described herein a high temperature electrical insulation suitable for electrical windings for any number of applications. The insulation comprises a cured preceramic polymer resin, which is preferably a polysiloxane resin made by Allied Signal and marketed under the trademark BLACKGLAS.

In another aspect of the invention, there is described a method for insulating electrical windings which are intended for use in high temperature environments, such as superconductors and the like. This method advantageously comprises the steps of, first, applying a preceramic polymer layer to a conductor core, to function as an insulation layer, and second, converting the initial preceramic resin into ceramic insulation, by curing the preceramic polymer layer. Of course, the conductor core preferably comprises a metallic wire, which may be wound into a coil. In the preferred method, the applying step comprises a step of wrapping the conductor core with a sleeve or tape of glass or ceramic fabric which has been impregnated by a preceramic polymer resin. In some embodiments, the preceramic polymer resin may be comprised of a polymer selected from the group consisting of polysilazanes, polycarbosilanes, polysiloxanes, polysilsesquioxanes, polyaluminosiloxanes, polyaluminosilazanes and polymetallosiloxanes. For certain applications, wherein a polysilazane polymer is chosen, the preceramic polymer may be selected from the group consisting of hydridopolysilazanes, silacyclobutasilazanes, boron-modified hydropolysilazanes, and vinyl-modified hydridopolysilazanes. Presently, it is preferred that the preceramic polymer is a polysiloxane resin sold under the trademark BLACKGLAS, and available from Allied Signal.

However, for other applications, the preceramic polymer may be selected from the group consisting of a spirosiloxane oligomer, a spirosiloxane polymer, and a polyvinylsilane, impregnated with said preceramic polymer resin by pouring or spraying the resin onto the sleeve or tape.

The present application is particularly advantageous because it comprises a ceramic composite insulator, suitable even for the harsh superconducting magnet environment, which combines the ease of processing of conventional organic insulation, but is also capable of withstanding the same heat treatment as the conductor itself. Even more beneficial, the present ceramic insulation may be applied in the same way as conventional organic insulation, using pre-preg tapes made from preceramic polymers. The attraction of a ceramic pre-preg that could be fired at the same time that the superconducting wire is being reacted is two-fold. First, it saves much time and expense by reducing processing steps and costs. By wrapping the ceramic onto the conduit, the same equipment used today for organic pre-preg insulation can be re-used. Second, more design flexibility is afforded, thereby allowing higher performance magnet coils to be fabricated.

The invention, together with additional features and advantages thereof, may best be understood by reference to the following description taken in conjunction with the accompanying illustrative drawing.

BRIEF DESCRIPTION OF THE DRAWINGS

The FIGURE is a cross-sectional view of a wire which has been insulated with ceramic insulation in accordance with the principles of the present invention.

DESCRIPTION OF THE PREFERRED EMBODIMENT

Referring now to the FIGURE, a typical embodiment wherein the ceramic insulation of the present invention has been applied is illustrated. As shown, a metallic wire or conductor core 10 is wrapped with a sleeve or tape of glass or ceramic fabric cloth 20 which has been impregnated with a preceramic polymer resin. The wire 10 is then wound into a coil or magnet. After shaping (winding), the assembly is heated to cure the preceramic polymer at approximately 50° C. to 200° C. The assembly is then heat treated to whatever time and temperature conditions are required to properly process the wire 10. Typical conditions for niobium tin superconductor magnets, for example, is 650° C. for 200 hours. Conditions can range, however, anywhere from 500° C. to 1400° C.

In the preferred embodiment, the preceramic polymer is a polysiloxane resin available from Allied Signal under the trademark BLACKGLAS, grade 493A. The ceramic fabric 20 is an aluminosilicate fabric, such as NEXTEL 312 aluminoborosilicate fabric, woven into a form suitable for the desired application, usually a thin tape. The tape is impregnated with the BLACKGLAS resin by pouring the resin onto the tape 20 or by running the tape through a bath of resin. The amount of resin added is sufficient to produce approximately 50 to 70 volume percent fibers and 30 to 50 volume percent ceramic matrix in the tape. The resin is allowed to partially cure on the tape 20 for several hours to ease handling. The conductor or conduit 10 is wrapped with the impregnated tape 20 to cover the surface thereof. Many different wrapping patterns are used, depending upon the mechanical, electrical, and dimensional requirements of the application device. The insulated conductor 10 is then wound into the desired coil. The coil is heated to cure the preceramic resin to a range of approximately 80° C. to 200° C., and preferably about 150° C. At this juncture, the coils is strong enough to be handled. The final heat treatment of the insulation layer 20 occurs along with the heat treatment of the particular wire 10. Advantageously, after heat treatment, the preceramic polymer insulation has been converted into ceramic insulation. The coil can be used at this stage, but is often then impregnated with a multifunctional epoxy resin to further increase strength.

In operation, it is first noted that the manner of using the inventive ceramic electrical insulation system is identical to that for using the prior art organic polymer insulation systems. The preceramic polymer resin, which Applicants have discovered creates unexpectedly good performance characteristics, may be applied to the wire 10 or impregnated into the fabric cloth 20 using the same equipment as presently used for organic insulation. Extruders, bath or dip coating, and "pre-preg" impregnation machinery can be utilized.

The operation of a finished insulated device also parallels that of devices made using organic insulation. The ceramic polymer insulation can withstand harsher environments, including extreme temperatures (4 K up to 1400° C.), ionizing and non-ionizing radiation, and higher compressive forces.

A number of alternative embodiments may be utilized within the scope of the invention. These embodiments substitute alternative materials to achieve specific performance goals. For example, any preceramic polymer or ceramic polymer precursor can be used with approximately equal success. The specific polymer used for any given application depends upon the specific requirements of the specific device. Preceramic polymers are defined as monomers or polymers that are liquid at the application temperature and that will polymerize to form a solid compound, and can be pyrolyzed at elevated temperatures to form a ceramic material. The polymer structure consists of inorganic molecules that link together to form chains. The ceramic structure can be amorphous or crystalline, depending upon composition and the processing temperature. The final ceramic material can form silica, silicon oxynitride, silicon carbide, silicon oxycarbide, metal silicates, metal nitrides, metal carbides, metal oxycarbides, alumina silicates, and other ceramic phases and mixtures thereof. While most preceramic polymers are based upon silicon, preceramics based on or containing alumina, magnesia, or zirconia should perform equally well. The selection of which chemistry is preferred is based on chemical compatibility with the conductor material. Boron or other elements can be added to modify the final properties. Presently other preceramic polymers that can be used include polyureasilazane (for example LANXIDE® CERASET® available from DuPont), hydridosiloxane, polycarbosilazane, polysilazane, perhydropolysilazane, other organosilazane polymers, cyclosiloxane monomer, silicate esters, and blends thereof. Other similar compounds can be used with equal success.

Many different types of reinforcements can also be used to modify the properties of the insulation 20 for a specific application. For example, glass or ceramic powders can be added to improve the compression strength and modulus of the insulation 20. Any of the many available glass, carbon, and ceramic fibers or whiskers can be added to improve the shear and tensile strength of the insulation. For example, alumina powders have been added to the preferred embodiment to increase the compression modulus by approximately 30%. A high purity silica fabric as well as an alumina fabric have been used successfully. These materials can be added to improve the ease of processing when trying to make thick sections. The preceramic polymer can be used without any additives when the desired insulation thickness is very thin.

In some embodiments, it may be desirable to reinfiltrate the heat treated coil or device, once fabricated in accordance with the above-described method, with additional preceramic polymer resin. The additional resin will fill some of the pores and voids left by the conversion of the polymer to the ceramic phase. The additional resin is heat treated to convert it to the ceramic phase. The reinfiltration can be performed one or more times. Strength and modulus properties have been increased by 30 to 50 percent by twice reinfiltrating the device with additional resin.

The ceramic insulation system can be used in most applications immediately after it has been heat treated to convert it into the ceramic form. However, some applications require the highest strength and the lowest porosity. An organic resin, typically an epoxy resin, can be infiltrated into pores and voids left by the conversion of the polymer to the ceramic phase. The device is used after curing the organic resin without further high temperature processing. Any of the common organic resins can be used for the infiltration.

The preferred embodiment entails a process using pre-impregnated tapes 20 to wrap around a wire or conduit 10. However, alternatively, the fiber cloth can be wrapped around the wire dry; i.e. without undergoing the pre-impregnation step. The coil is then wound as desired. After shaping, the coil is placed in a closed mold. The preceramic polymer resin is then transferred into the mold using a resin transfer molding process or a vacuum pressure infiltration process. Both of these techniques and modifications of them are common in the composite fabrication industry. The mold with the coil inside is heated to allow the resin to cure and harden. After the coil is removed from the mold, it is heat treated according to the specifications for the wire.

Another inventive method for coating the wires 10 involves mixing up a slurry comprising the preceramic polymer resin and the desired powder or whisker reinforcements, if any. The wire is then dipped into this bath of resin for coating. Polymer extrusion machines can also be used to extrude the preceramic slurry around the outside of the wire. These methods are known, in general terms, in the metal wire fabrication industry, but not for the purpose of applying a preceramic polymer insulation thereto.

Accordingly, it can be seen that the inventive preceramic polymer insulation may be used for coils, transformers, and magnets to obtain improved performance in extreme environments. In addition, reduced fabrication costs can be obtained through the elimination of complex unwinding and rewinding steps necessary for some brittle superconductor wire systems.

In summary, the advantages of using the preceramic polymer-based insulation of the present invention include the following:

a) higher temperature operation is permitted than is possible with organic insulation. No design changes or additional costs associated with cooling or thermal barriers are required. The maximum temperature during operation is limited only by the temperature stability of the metallic conductor. The ceramic insulation can withstand temperatures above 1400° C., where most metals are too weak to function;

b) coils and magnets can be fabricated prior to any high temperature processing steps. The coil or magnet can be shaped before any heat treatment, while the wire is in its normal, ductile state. Tight, small coils can be made because of this advantage, and the preceramic polymer insulation is applied before heat treatment;

c) existing equipment which is made for applying organic insulation may be used for the application of the inventive ceramic insulation. With the exception of the above-described high temperature conversion step, the inventive system is advantageously able to use the same procedures and methods which have been used to apply organic insulation in the past. Layers can be dip coated or extruded directly onto the wire or conduit. Alternatively, pre-impregnated fabric tapes can be fabricated that incorporate the preceramic polymer, which are then wrapped around the conductor. The insulation can be applied in a single layer;

d) a wide processing temperature range may be used without reformulating the insulation system. The polymer converts to a ceramic matrix at temperatures ranging anywhere from approximately 500° C. to 1400° C. The system does not depend upon softening and flow of material at high temperatures. Different kinds of wires and superconductors can be insulated with one composition. The strength and electrical performance of the preceramic insulation is not dependent upon reaching very high temperatures necessary for fusing individual powder particles together. Also, the preceramic polymer insulation can be processed at the same time as the superconductor materials are heat treated at low temperatures (600° C. to 1000° C.);

e) increased radiation resistance is provided as compared to prior art insulation approaches. Once the insulation has been converted into its ceramic form, it is much less susceptible to damage. This permits application of the inventive insulation to devices where radiation would damage organic insulation, without requiring radiation shielding. Also, useful lifetimes of the insulation are greatly increased;

f) many different kinds of additives can be used to tailor the properties of the insulation to a specific device or application. Other materials, such as powders, whiskers, and fibers, can be added to improve specific properties without significantly degrading the baseline properties. Thermal conductivity, specific heat, strength, toughness and modulus are some of the properties that can be adjusted to meet new application requirements;

g) the preceramic resins are relatively fixed in composition and do not rely on varying the composition in order to achieve the desired processability. Small variations in the components in insulation do not affect the properties during processing;

h) preceramic polymer resins can be impregnated into glass, ceramic or carbon fabrics and then wrapped around the conductor. The resins can also be impregnated into the cloth after it has been wrapped around the conductor. The mechanical strength of the coil or magnet is higher than if a fabric is not used.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention. For example, the specific preceramic polymer used for the matrix of the invention could be any preceramic polymer. Each system would have slightly different properties, but the main processing and operational advantages are common to all. Also, the glass or ceramic reinforcing fabric could be one of the many fabrics that are commercially available with temperature ratings compatible with the desired processing temperature. Alumina, aluminum nitride, silica, or other glass or ceramic powders could be added to obtain improvements in specific properties. Applications for the inventive insulation system may include, for example, motors, generators, magnetic bearings, potentiometers, solenoids, transformers, and electromagnetic or sensing coils, and apparatus which incorporate such devices.

What is claimed is:

1. A high temperature electrical insulation for electrical windings, comprising at least one preceramic polymer resin selected from a group consisting of polysilazane resins, polycarbosilane resins, polysiloxane resins, polysilsesquioxane resins, polyaluminosiloxane resins, polyaluminosilazane resins, polymetallosiloxane resins, polyureasilazane resins, hydridosiloxane resins, polycarbosilazane resins, and perhydropolysilazane resins.

2. A high temperature electrical insulation for electrical windings, comprising at least one cured preceramic polymer resin and an organic polymer resin which is combined with said cured preceramic polymer resin.

3. The high temperature electrical insulation as recited in claim 2, wherein the organic content of said electrical insulation is approximately 1% to 40% by volume.

4. The high temperature electrical insulation as recited in claim 2, further comprising a glass or ceramic powder added to the preceramic polymer resin prior to cure.

5. The high temperature electrical insulation as recited in claim 2, further comprising at least one reinforcing additive in the preceramic polymer resin, the at least one additive selected from a group consisting of powders, whiskers, and fibers.

6. The high temperature electrical insulation as recited in claim 2, wherein the at least one preceramic polymer resin comprises at least one polymer selected from the group consisting of polysilazanes, polycarbosilanes, polysiloxanes, polysilsesquioxanes, polyaluminosiloxanes, polyaluminosilazanes, polymetallosiloxanes, polyureasilazane, hydridosiloxane, polycarbosilazane, and perhydropolysilazane.

7. The high temperature electrical insulation as recited in claim 2, wherein the at least one cured preceramic polymer is at least one polysilazane polymer selected from the group consisting of hydridopolysilazanes, silacyclobutasilazanes, boron-modified hydropolysilazanes, and vinyl-modified hydridopolysilazanes.

8. The high temperature electrical insulation as recited in claim 2, wherein the at least one preceramic polymer is selected from the group consisting of a spirosiloxane oligomer, a spirosiloxane polymer, and a polyvinylsilane.

9. A high temperature electrical insulation for electrical windings, comprising a liquid polysiloxane resin.

10. The electrical insulation of claim 9, further comprising an organic polymer resin combined with the polysiloxane resin.

11. The electrical insulation of claim 9, further comprising a fabric impregnated with the polysiloxane resin.

12. The electrical insulation of claim 9, wherein the polysiloxane resin is a ceramicized polysiloxane resin.

13. The electrical insulation of claim 12, further comprising an organic polymer resin combined with the ceramicized polysiloxane resin.

14. A high temperature electrical insulation for electrical windings, comprising a preceramic polymer resin and a fabric impregnated with the preceramic polymer resin.

* * * * *